US007427310B2

(12) United States Patent
Tillman et al.

(10) Patent No.: US 7,427,310 B2
(45) **Date of Patent: *Sep. 23, 2008**

(54) CEMENTED CARBIDE TOOLS FOR MINING AND CONSTRUCTION APPLICATIONS AND METHOD OF MAKING SAME

(75) Inventors: Mathias Tillman, Hägersten (SE); Susanne Norgren, Huddinge (SE); Marianne Collin, Skarpnäck (SE)

(73) Assignee: Sandvik Intellectual Property AB, Sandviken (SE)

( * ) Notice: Subject to any disclaimer, the term of this patent is extended or adjusted under 35 U.S.C. 154(b) by 495 days.

This patent is subject to a terminal disclaimer.

(21) Appl. No.: 11/011,137

(22) Filed: Dec. 15, 2004

(65) Prior Publication Data

US 2005/0147850 A1 Jul. 7, 2005

(30) Foreign Application Priority Data

Dec. 15, 2003 (SE) ..... 0303360
Dec. 22, 2003 (SE) ..... 0303486

(51) Int. Cl.
*C22C 29/08* (2006.01)

(52) U.S. Cl. ..... 75/240; 428/547

(58) Field of Classification Search ..... 75/240; 428/547

See application file for complete search history.

(56) References Cited

U.S. PATENT DOCUMENTS

| | | | | |
|---|---|---|---|---|
| 4,359,335 | A | 11/1982 | Garner | |
| 4,743,515 | A | 5/1988 | Fischer et al. | |
| 4,843,039 | A | 6/1989 | Akesson et al. | |
| 5,403,652 | A | 4/1995 | Drougge | |
| 5,623,723 | A | 4/1997 | Greenfield | |
| 5,856,626 | A * | 1/1999 | Fischer et al. | 75/240 |
| 5,945,207 | A * | 8/1999 | Kutscher et al. | 428/216 |
| 5,948,523 | A | 9/1999 | Carpenter et al. | |
| 6,267,797 | B1 * | 7/2001 | Ostlund et al. | 75/240 |
| 2004/0009088 | A1 * | 1/2004 | Glatzle et al. | 419/14 |
| 2005/0129951 | A1 | 6/2005 | Collin et al. | |

FOREIGN PATENT DOCUMENTS

| | | | |
|---|---|---|---|
| EP | 0 194 018 | A1 | 9/1986 |
| EP | 0 257 869 | A2 | 3/1988 |
| EP | 0 344 421 | B1 | 2/1995 |
| EP | 0 687 744 | A2 | 12/1995 |
| EP | 0 499 223 | B1 | 5/1996 |
| EP | 0 951 576 | B1 | 10/1999 |
| EP | 0 438 916 | B2 | 12/2000 |
| JP | 4128330 | * | 4/1992 |
| WO | 98/28455 | A1 | 7/1998 |

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

A cemented carbide cutting tool insert/button for mining and construction comprising hard constituents in a binder phase of Co and/or Ni and at least one surface portion and an interior portion in which surface portion the grain size is smaller than in the interior portion is disclosed. The surface portion with the smaller grain size has a lower binder phase content than the interior portion. A method to form the cemented carbide cutting tool insert/button is also disclosed.

21 Claims, 3 Drawing Sheets

CEMENTED CARBIDE TOOLS FOR MINING AND CONSTRUCTION APPLICATIONS AND METHOD OF MAKING SAME

RELATED APPLICATION DATA

This application is based on and claims priority under 35 U.S.C. §119 to Swedish Application No. 0303360-2, filed Dec. 15, 2003, the entire contents of which are incorporated herein by reference. This application is also based on and also claims priority under 35 U.S.C. §119 to Swedish Application No. 0303486-5, filed Dec. 22, 2003, the entire contents of which are incorporated herein by reference.

FIELD OF THE DISCLOSURE

The present disclosure relates to cemented carbide bodies, e.g., tools used for drilling/cutting of rock and mineral. Also cemented carbide tools used for asphalt and concrete are included. More specifically, the disclosure pertains to cemented carbide tools made via sintering techniques wherein there are two distinct microstructural zones having complementary properties.

In cemented carbides, the grain size, as well as the binder phase (e.g., cobalt) content, each has an influence on the performance of the composite. For example, a smaller/finer grain size of the tungsten carbide results in a more wear resistant material. An increase in cobalt content typically leads to an increase in toughness.

Cemented carbides having a fine grain size are produced through the incorporation of grain refiners in the initial powder blend. Such cemented carbide has a fine grain size throughout its microstructure. Cemented carbide with a coarse grain size is produced via sintering without the incorporation of any grain refiners since the tendency of a cemented carbide like a WC–Co composite is for the WC grains to coarsen during sintering. Such cemented carbide has a coarse grain size throughout its microstructure. As can be appreciated, these hard bodies typically have a uniform microstructure throughout the cemented carbide body.

STATE OF THE ART

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Cemented carbide bodies having at least two distinct microstructural zones are known in the art. For example, drills having a core of a tough cemented carbide grade and a cover of a more wear resistant grade are disclosed in EP-A-951576.

EP-A-194018 relates to a wire drawing die made from a central layer with coarse grained tungsten carbide particles and a peripheral layer with finer grained tungsten carbide particles. Initially, the layers have the same content of cobalt. After sintering, the coarse grained layer in the center is reduced in cobalt content.

EP-A-257869 discloses a rock bit button made with a wear resistant tip portion and a tough core. The tip portion is made from a powder with low Co-content and a fine WC grain size and the core portion is made from a powder with high Co content and coarse WC grains. Nothing is disclosed about the Co-content in the two portions after sintering. However, also in this case the Co-content in the coarse grained portion will be reduced at the expense of the Co-content in the fine grained layer. A similar disclosure is found in U.S. Pat. No. 4,359,335.

An alternative approach is disclosed in U.S. Pat. No. 4,743,515, which discloses cemented carbide bodies, preferably for rock drilling and mineral cutting. The bodies comprise a core of cemented carbide containing eta-phase surrounded by a surface zone of cemented carbide free of eta-phase and having a low content of cobalt in the surface and a higher content of cobalt next to the eta-phase zone. U.S. Pat. No. 4,843,039 is similar, but it relates to cutting tool inserts for metal machining.

U.S. Pat. No. 5,623,723 discloses a method of making a cemented carbide body with a wear resistant surface zone. The method includes the following steps: providing a compact of cemented carbide; placing a powder of grain refiner on at least one portion of the exposed surface of the compact; and heat treating the compact and grain refiner powder so as to diffuse the grain refiner toward the center of the green compact thereby forming a surface zone inwardly from the exposed surface in which the grain refiner was placed, and forming an interior zone. As a result, a cemented carbide body is obtained with a surface zone having a grain size that is smaller but with a Co-content that is higher than that of the interior portion of the body. This means that the increased wear resistance that is obtained as a result of the smaller WC grain size is to a certain extent lost by the increase in Co-content.

SUMMARY

Exemplary embodiments of a cemented carbide body with a surface zone with a low binder phase content and fine WC grain size and thus high wear resistance and exemplary methods of making the same are provided.

Exemplary embodiments of a cemented carbide insert/button with compressive stresses in the surface portion, which has a positive effect upon the strength and the toughness of the insert/button, are also provided.

An exemplary embodiment of a cemented carbide tool insert/button for mining and construction comprises a cemented carbide body comprising hard constituents in a binder phase of Co and/or Ni, and at least one surface portion and an interior portion. The surface portion has a smaller WC grain size than the interior portion. The surface portion with the fine grain size has a lower binder phase content than the interior portion.

Another exemplary embodiment of a cemented carbide tool insert/button for mining and construction comprises a cemented carbide body comprising WC+binder in a binder phase of Co and/or Ni with a nominal binder phase content of 4 to 25 wt-%, and at least one surface portion and an interior portion. The surface portion has a nominal WC grain size less than 0.9 of the nominal WC grain size in the interior portion, and the surface portion has a binder phase content less than 0.9 of the binder phase content in the interior portion. The surface portion contains Cr, and a ratio of parameter A to parameter B is greater than 1.5, where parameter A=[(wt-% Cr/wt-% binder phase)+0.01] in the surface portion and parameter B=[(wt-% Cr/wt-% binder phase)+0.01] taken at a part of the cemented carbide body having the lowest Cr content. The nominal WC grain size, arithmetic mean of intercept, is 1 to 15 μm, and the surface portion has a width of 0.05 to 0.9 of the diameter/width of the cemented carbide body.

An exemplary method of making a cemented carbide body with a wear resistant surface zone comprises providing a compact of cemented carbide from a single powder mixture, optionally presintering the compact and grinding the compact to a desired shape and size, placing a powder of a grain refiner containing carbon and/or nitrogen on at least one portion of an exposed surface of the compact, the grain refiner containing C and/or N, sintering the compact and grain refiner powder to diffuse the grain refiner toward the center of the compact to form a surface portion in the sintered compact and to form an interior portion in the sintered compact, optionally adding an isostatic gas pressure during a final stage of sintering, optionally post-HIP-ing at a temperature lower than the sintering temperature and at a pressure of 1-100 MPa, optionally grinding to a final shape and optionally removing undesired carbides and/or graphite from the surface, wherein the surface portion has a smaller WC grain size than the interior portion and wherein the surface portion has a lower cobalt content than the interior portion.

BRIEF DESCRIPTION OF THE DRAWING FIGURES

The following detailed description of preferred embodiments can be read in connection with the accompanying drawings in which like numerals designate like elements and in which.

Figure 3A:
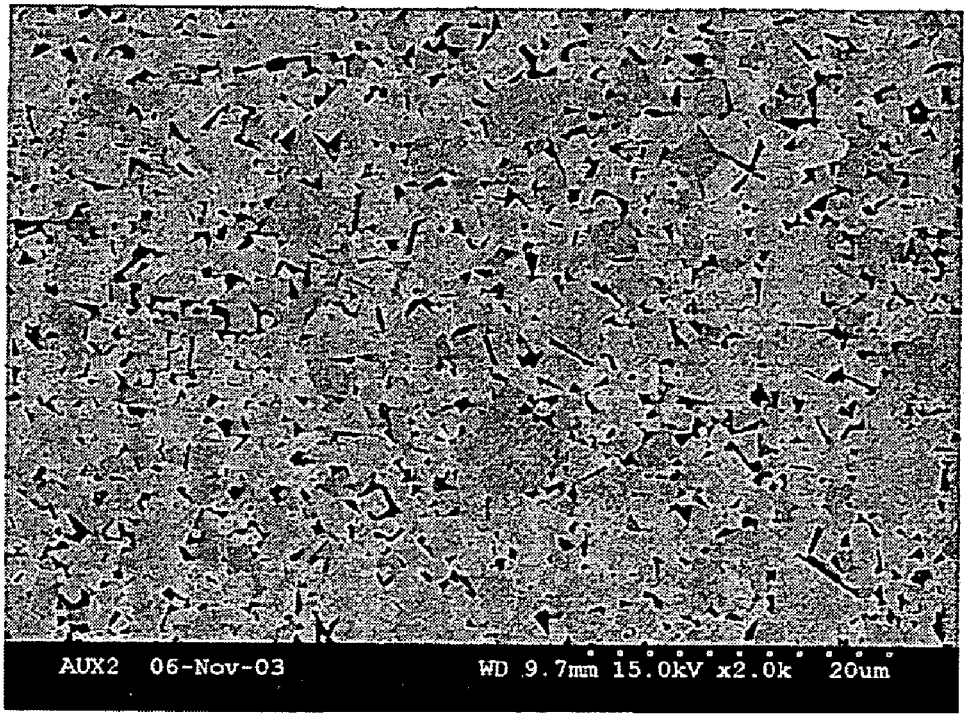

FIG. 3*a* is a micrograph showing the microstructure at a distance of 20 μm from the surface where the grain refiner powder was placed (FEG-SEM, 2000X, BSE mode) on an exemplary embodiment of a button.

Figure 3B:
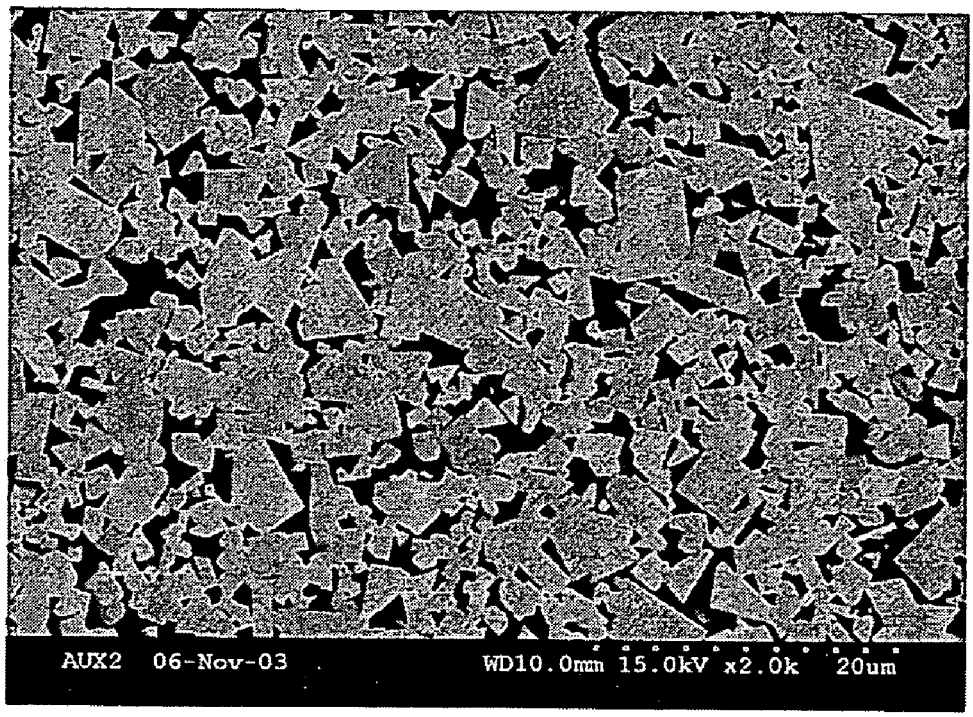

FIG. 3*b* is a micrograph showing the microstructure at a distance of 2.5 mm from the surface where the grain refiner powder was placed (FEG-SEM, 2000X, BSE mode) in an exemplary embodiment of a button.

Figure 3C:
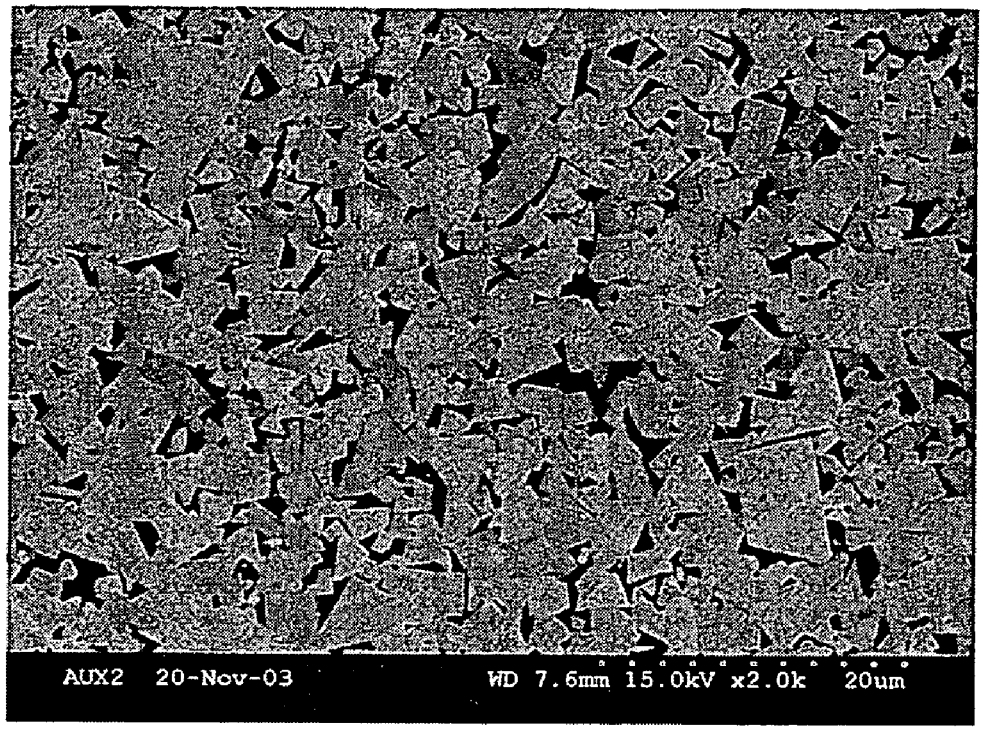

FIG. 3*c* is a micrograph showing the microstructure in the interior portion (center) of an exemplary embodiment of a button (FEG-SEM, 2000X, BSE mode).

DETAILED DESCRIPTION OF PREFERRED EMBODIMENTS

It has now surprisingly been found that it is possible from a single mixture of tungsten carbide and binder to obtain a cemented carbide body with a surface portion with a smaller grain size and a lower cobalt content than those in the interior portion.

According to the present disclosure, there is provided a cemented carbide tool insert/button for mining and construction applications comprising a cemented carbide body comprising at least one surface portion and an interior portion. The surface portion is poor in binder and has a width of 0.05-0.9 of the diameter/width of the cemented carbide body. In other exemplary embodiments, the surface portion has a width 0.1-0.5 of the diameter/width of the cemented carbide body, or a width 0.15-0.4 of the diameter/width of the cemented carbide body. In exemplary embodiments, the grain size in the surface portion is smaller than in the interior portion and the Co-content is lower than that in the interior portion resulting in compressive stresses at the surface after sintering. More particularly, in some embodiments the Co-content of the surface portion is <1, alternatively <0.9, alternatively <0.75 of the Co-content in the interior portion. Also, some embodiments have a WC grain size in the surface zone of <1, alternatively <0.9, alternatively <0.8 of the WC grain size in the interior portion. In another exemplary embodiment, the surface portion contains Cr such that the ratio between the parameter A=((wt-% Cr/wt-% binder phase)+0.01) in the surface portion and the parameter B=((wt-% Cr/wt-% binder phase)+0.01) taken at the part of the body that is characterized by the lowest Cr content is A/B>1.5, alternatively in some exemplary embodiments A/B>3.0.

The composition of the cemented carbide is WC+Co. Examples of the composition have a nominal Co-content of 4-25 wt-%, alternatively 5-10 wt-% and a nominal WC grain size, arithmetic mean of intercept, of 1-15 μm, alternatively 1.5-5 μm.

In an exemplary embodiment, the cemented carbide contains η-phase (eta-phase).

In another exemplary embodiment, there is a maximum in Co-content between the fine grained and the coarse grained portion. For example, a maximum in Co-content can occur at a location in the cemented carbide body between an outermost surface of the surface portion and an outermost region of the interior portion An exemplary method of making a cemented carbide body with a wear resistant surface zone comprises the following steps:

- providing a compact of cemented carbide made from a single powder mixture, the single powder mixture comprising powders forming hard constituents and a binder phase of Co and/or Ni;
- optional grinding the compact to a desired shape and size;
- placing a powder of a grain refiner on at least one portion of the exposed surface of the compact by dipping, spraying, painting, applying a thin tape or in any other way. The grain refiner in one exemplary method being any chromium carbide (e.g., $Cr_3C_2$, $Cr_{23}C_6$ and $Cr_7C_3$ or mixtures of these) or a mixture of chromium and carbon or other compounds containing chromium and carbon and/or nitrogen;
- sintering the compact and grain refiner powder so as to diffuse the grain refiner away from the surface(s) on which the grain refiner was placed to form a gradient zone in a surface portion of the sintered compact, the gradient zone having low binder phase content, a higher chromium content and a lower WC grain size as compared to an interior portion of the sintered compact;
- optionally adding an isostatic gas pressure during the final stage of sintering;
- optionally post-HIP-ing at a temperature lower than the sintering temperature and at a pressure of 1-100 MPa;
- optionally grinding to a final shape; and
- optionally removing undesired carbides and/or graphite from the surface using grinding or any other mechanical method.

The nominal carbon content of the cemented carbide compact is determined by, amongst other things, consideration of the carbon contribution from the applied grain refiner. Also, compacts that would result in an eta-phase containing microstructure can be used.

Sintering can be performed for shortest possible time to obtain a dense body with a surface portion with a smaller grain size and lower cobalt content than those in the interior portion. Also, the sintering can be performed for the shortest possible time to obtain the desired structure and a body with closed porosity, preferably a dense body. This time depends on the grain size of WC and the composition of the cemented carbide. It is within the purview of the person skilled in the art to determine whether the requisite structure has been obtained and to modify the sintering conditions in accordance with the present specification. If necessary or desired, the body can optionally be post-HIP-ed at a lower HIP-temperature compared to the sintering temperature and at a pressure of 2 to 100 MPa.

Alternatively, the grain refiner/chromium carbide powder is placed on a pre-sintered body that is subsequently heat treated to obtain the desired structure at a temperature higher than the temperature for pre-sintering.

EXAMPLE 1

Figure 1:
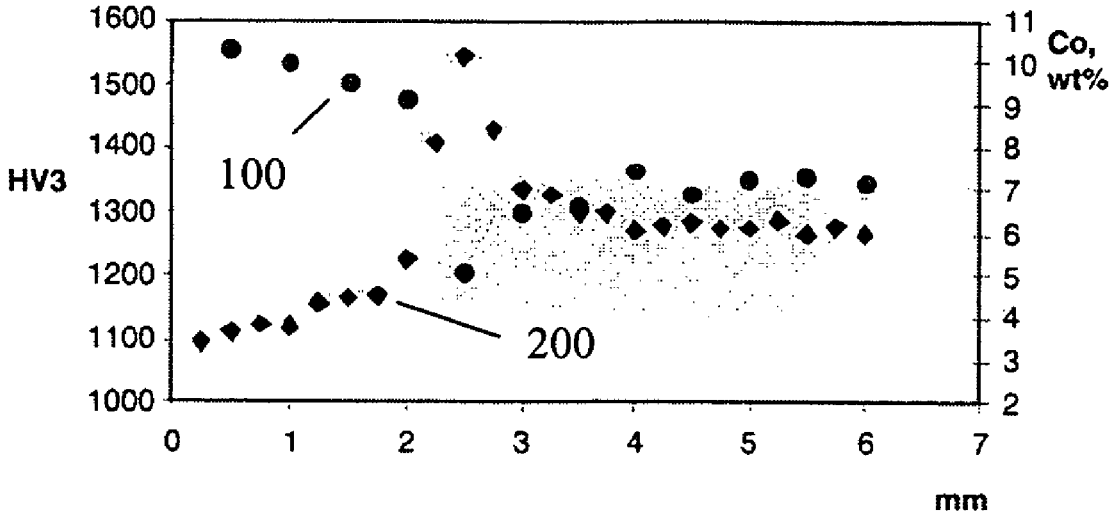
FIG. 1 is a graph showing hardness (HV3) and cobalt content (WDS-analysis) versus distance from the surface in an exemplary embodiment of a cemented carbide where the grain refiner powder was placed on a button for mining application.
Figure 2:
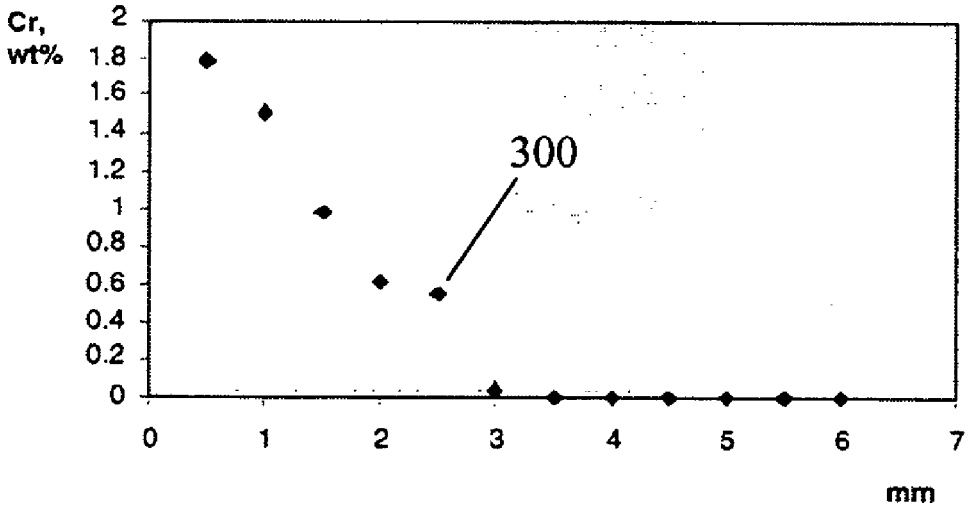
FIG. 2 is a graph showing chromium content (WDS-analysis) versus distance from the surface in an exemplary embodiment of a cemented carbide where the grain refiner powder was placed on a button.

Cemented carbide compacts were made according to the following: Cylindrical green compacts were pressed (diameter 12 mm) from a powder with the composition of 94 weight-% WC and 6 weight-% Co. The WC raw material was relative coarse-grained with an average grain size of 3.0 μm FSSS). All surfaces were covered with a $Cr_3C_2$ containing layer (0.02 g $Cr_3C_2/cm^2$). Thereafter the compacts were sintered at 1350° C. for 30 minutes. During the last 15 minutes of the sintering, an isostatic gas pressure of 10 MPa was applied to obtain a dense body. A cross-section of the sintered button was examined. No $Cr_3C_2$ was observed on the surface. FIG. 1 shows a graph of hardness 100 and cobalt content 200 versus the distance to the previously $Cr_3C_2$-covered surface. The cobalt content 200 is lowest close to the surface and increases with increasing distance to a maximum value and then decreases again. The hardness 100 is highest close to the surface and decreases with the distance to a minimum value and then increases again towards the center. FIG. 2 shows a graph of chromium content 300 versus the distance to the previously $Cr_3C_2$-covered surface. The chromium content 300 is highest close to the surface and decreases with the distance. FIG. 3*a* is a micrograph showing the microstructure at a distance of 20 μm from the previously $Cr_3C_2$-covered surface (FEG-SEM, 2000X, BSE mode). FIG. 3*b* shows the microstructure at a distance of 2.5 mm from the previously $Cr_3C_2$-covered surface (FEG-SEM, 2000X, BSE mode). FIG. 3*c* is a micrograph showing the microstructure in the interior portion (6 mm from the previously $Cr_3C_2$-covered surface) of the button (FEG-SEM, 2000X, BSE mode). The WC-grain sizes measured as arithmetic mean of intercept values are presented in Table 1.

TABLE 1

| Distance from surface | Mean grain size [μm] |
|---|---|
| 20 μm | 1.5 |
| 2.5 mm | 1.8 |
| 6.0 mm | 1.8 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cemented carbide tool insert/button for mining and construction comprising:

a cemented carbide body comprising hard constituents in a binder phase of Co and/or Ni, and at least one surface portion and an interior portion, wherein the surface portion has a WC grain size smaller than the interior portion, wherein the surface portion with the smaller WC grain size has a lower binder phase content than the interior portion, wherein the surface portion contains Cr, and a ratio of parameter A to parameter B is greater than 3.0, where parameter A=[(wt-% Cr/wt-% binder phase)+0.01] in the surface portion and parameter B=[(wt-% Cr/wt-% binder phase)+0.01] taken at a part of the cemented carbide body having the lowest Cr content, wherein a maximum in Co-content occurs at a location in the cemented carbide body between an outermost surface of the surface portion and an outermost region of the interior portion, and wherein the Co-content in a region inward of the location of the maximum in Co-content is lower than the maximum.

2. The cemented carbide tool insert/button according to claim 1, wherein the binder phase content of the surface portion is less than 0.9 of that in the interior portion.

3. The cemented carbide tool insert/button according to claim 2, wherein the binder phase content of the surface portion is less than 0.75 of that in the interior portion.

4. The cemented carbide tool insert/button according to claim 1, wherein the WC grain size of the surface portion is less than 0.9 of that in the interior portion.

5. The cemented carbide tool insert/button according to claim 4, wherein the WC grain size of the surface portion is less than 0.8 of that in the interior portion.

6. The cemented carbide tool insert/button according to claim 1, wherein the surface portion has a width of 0.05 to 0.9 of a diameter/width of the cemented carbide body.

7. The cemented carbide tool insert/button according to claim 6, wherein the width is 0.1 to 0.5 the diameter/width of the cemented carbide body.

8. The cemented carbide tool insert/button according to claim 7, wherein the width is 0.15 to 0.4 the diameter/width of the cemented carbide body.

9. The cemented carbide tool insert/button according to claim 1, wherein a composition of the cemented carbide body is WC+binder with a nominal binder phase content of 4 to 25 wt-%, and a nominal as sintered WC grain size, arithmetic mean of intercept, of 1 to 15 μm.

10. The cemented carbide tool insert/button according to claim 9, wherein the nominal binder phase content is 5 to 10 wt-%.

11. The cemented carbide tool insert/button according to claim 9, wherein the nominal as sintered WC grain size arithmetic mean of intercept is 1.5 to 5 μm.

12. The cemented carbide tool insert/button according to claim 1, wherein the cemented carbide body comprises η-phase.

13. A cemented carbide tool insert/button for mining and construction comprising:

a cemented carbide body comprising

WC+binder in a binder phase of Co and/or Ni, a nominal binder phase content being 4 to 25 wt-%, and at least one surface portion and an interior portion, wherein the surface portion has a nominal WC grain size less than 0.9 of a nominal WC grain size in the interior portion, wherein the surface portion has a binder phase content less than 0.9 of a binder phase content in the interior portion, wherein the surface portion contains Cr, and a ratio of parameter A to parameter B is greater than 1.5, where parameter A=[(wt-% Cr/wt-% binder phase)+0.01] in the surface portion and parameter B=[wt-% Cr/wt-% binder phase)+0.01] taken at a part of the cemented carbide body having the lowest Cr content wherein the nominal WC grain size, arithmetic mean of intercept, is 1 to 15 μm, wherein the surface portion has a width of 0.05 to 0.9 of a diameter/width of the cemented carbide body, wherein a maximum in Co-content occurs at a location in the cemented carbide body between an outermost surface of the surface portion and an outermost region of the interior portion, and wherein the Co-content in a region inward of the location of the maximum in Co-content is lower than the maximum.

14. The cemented carbide tool insert/button according to claim 13, wherein the binder phase content of the surface portion is less than 0.75 of that in the interior portion.

15. The cemented carbide tool insert/button according to claim 13, wherein the WC grain size of the surface portion is less than 0.8 of that in the interior portion.

16. The cemented carbide tool insert/button according to claim 13, wherein the ratio of parameter A to parameter B is greater than 3.0.

17. The cemented carbide tool insert/button according to claim 13, wherein the width is 0.1 to 0.5 the diameter/width of the cemented carbide body.

18. The cemented carbide tool insert/button according to claim 17, wherein the width is 0.15 to 0.4 the diameter/width of the cemented carbide body.

19. The cemented carbide tool insert/button according to claim 13, wherein the nominal binder phase content is 5 to 10 wt-%.

20. The cemented carbide tool insert/button according to claim 13, wherein the nominal as sintered WC grain size arithmetic mean of intercept is 1.5 to 5 μm.

21. The cemented carbide tool insert/button according to claim 13, wherein the cemented carbide body comprises η-phase.

* * * * *